US007218746B2

(12) United States Patent
Schmidt et al.

(10) Patent No.: US 7,218,746 B2
(45) Date of Patent: May 15, 2007

(54) RETRACTABLE SPA SPEAKER SYSTEM

(75) Inventors: Darrell Schmidt, Simi Valley, CA (US); Francisco Hinojosa, Jr., Santa Paula, CA (US); Michael D. Holtsnider, Moorpark, CA (US); Raymond Colin, Simi Valley, CA (US); Stephen L. Samuels, Ventura, CA (US)

(73) Assignee: B & S Plastics, Inc., Oxnard, CA (US)

( * ) Notice: Subject to any disclaimer, the term of this patent is extended or adjusted under 35 U.S.C. 154(b) by 375 days.

(21) Appl. No.: 10/359,908

(22) Filed: Feb. 7, 2003

(65) Prior Publication Data

US 2004/0156517 A1 Aug. 12, 2004

(51) Int. Cl.
*H04R 25/00* (2006.01)
*A47K 3/00* (2006.01)

(52) U.S. Cl. ..... 381/334; 381/335; 4/541.1

(58) Field of Classification Search ..... 381/361, 381/386, 395, 387, 334, 345; 4/541.1; 248/300
See application file for complete search history.

(56) References Cited

U.S. PATENT DOCUMENTS 6,754,916 B1 * 6/2004 Cox ..... 4/541.1

OTHER PUBLICATIONS

Sugatsune, , D Latches/Catches, Lamp, p. 82.

SDP Inch, Neg'Ator Constant Force Springs, 9 Miscellaneous Components, p. 9-42.

* cited by examiner

*Primary Examiner*—Curtis Kuntz
*Assistant Examiner*—Tuan Duc Nguyen
(74) *Attorney, Agent, or Firm*—Koppel, Patrick, Heybl & Dawson

(57) ABSTRACT

A spa speaker system is disclosed having a housing with a speaker mounted within it. The housing is movably mounted to a track with the housing extendible and retractable from the top of the track. A spring is arranged to urge the housing to extend from the top of the track. A latching mechanism is operable to hold the housing in its retracted position and is thereafter operable to release the housing. The housing extends from the track when the housing is released by the latching mechanism. A system for providing audio to a reservoir of water is also disclosed. The system comprises a reservoir shell capable of holding water and at least one speaker system according to the invention mounted to said reservoir shell above the water line. Each of the speaker systems is independently extendible from the shell.

28 Claims, 8 Drawing Sheets

RETRACTABLE SPA SPEAKER SYSTEM

BACKGROUND OF THE INVENTION

1. Field of the Invention

This invention relates to spas and more particularly to a retractable speaker system for spas.

2. Description of the Related Art

Reservoirs of water such as pools, spas, bathtubs and the like (collectively referred to as "spas" or "spa") are more commonly being constructed with features such as televisions and audio systems. For the occupants of the spa to hear the television or audio system, a number of speakers can be included around the spa, with a common location being the edge of the spa above the waterline. The speakers are arranged so that the sound they produce is directed toward the spa occupants and the sound can be heard over the noise of the spa's plumbing system.

One conventional way of mounting speaker systems around the edge of spas having Acrylic or fiberglass spa bodies is to form "ears" or extensions in the spa body and to mount a respective speaker in each of the ears. The ears are formed during the spa fabrication process and they provide fixed and permanent housings for the speakers. The ears are usually arranged around the edge of the spa and extend above the edge, with a typical location being in the corners of a rectangular/square spa. When the speakers are installed in the ears, their sound is directed in toward the spa occupants.

One disadvantage of the ear type spa speaker system is that the extra step of forming the ears in the acrylic or fiberglass body can add significant cost to the spa. Spas with ears also require additional storage and shipping space because the ears extend above the top surface of the spa. Shipping and storing of these spas can also be awkward because the ears prevent the spas from being securely stacked on top of one another. The ears can also make it difficult to produce a cover that closely fits over the spa, and the speakers in the ears are permanently fixed so that they cannot be retracted when not in use.

Other spa speaker systems have been developed that have speaker housings that extend from the top edge of the spa during use and can then be retracted below the edge when not in use. Holes are created around the edge of the spa and the speaker systems are mounted within the holes. When the speaker housings are fully retracted, their-top surface is substantially flush with the surface of the spa. The speaker housings can extend under the force of an air pump/cylinder or a hydraulic system, both of which are usually housed behind the wall of the spa body and push the speakers up from the bottom. The speaker systems can be connected to a single air or hydraulic driving system so that the air or hydraulic extenders can be simultaneously actuated to simultaneously extend the speaker housings.

One disadvantage of these types of speaker systems is that each speaker system requires its own air or hydraulic actuator, and requires at least one actuator driving system. The actuator and driving system adds significant cost and complexity, which can lead to failures. Space behind the wall of a spa is often a premium, particularly for portable spas. The plumbing and electrical systems consume most of the space behind the spa wall, leaving little space for speaker systems. Speaker systems with air and hydraulic actuators consume an excessive amount of space behind the spa wall because the air/hydraulic actuator is attached to the bottom of each speaker system, significantly increasing its overall length. Further, in many conventional speaker systems the speakers are not individually extendible, so that the sound produces by the speakers cannot be tailored to the location of the occupants in the spa.

SUMMARY OF THE INVENTION

The present invention seeks to provide a spa speaker system that consumes less space behind the spa wall, is less costly and less complex. The invention also seeks to provide a speaker system that is easy to install and use and includes a speaker housing that can be easily and independently extended and retracted.

One embodiment according to the invention comprises a spa speaker system having a housing with a speaker mounted within it. The housing is movably mounted to a track and the housing is extendible and retractable from the top of the track. A spring is included that urges the housing to extend from the top of the track. A latching mechanism is operable to hold the housing in its retracted position. The latching mechanism is thereafter operable to release the housing, with the housing extending from the track when the housing is released by the mechanism.

A further embodiment according to the invention comprises a system for providing audio to a reservoir of water. The system comprises a reservoir shell capable of holding water and at least one speaker system mounted to said reservoir shell above the water line. Each of the speaker systems is capable of receiving an audio signal and generating sound toward occupants of the reservoir shell. Each of the speaker systems comprises a speaker housing that is retractable to be hidden behind the reservoir shell and is extendible from the reservoir shell. Each of the speaker housings is extendible independent of the other speaker systems. An audio system generates an audio signal and transmits the signal to the speaker systems.

These and further features and advantages of the invention will be apparent to those skilled in the art from the following detailed description, taken together with the accompanying drawings, in which:

DETAILED DESCRIPTION OF THE INVENTION

FIGS. 1–4 show one embodiment of a spa speaker system 10 according to the present invention. Most of the system's components are formed from a water impervious plastic such as CPVC, PVC, or ABS. The speaker system 10 is particularly adapted to be integrated with a spa so that it can be extended from a surface of the spa above the waterline, and retracted below the surface when not in use.

Figure 5:
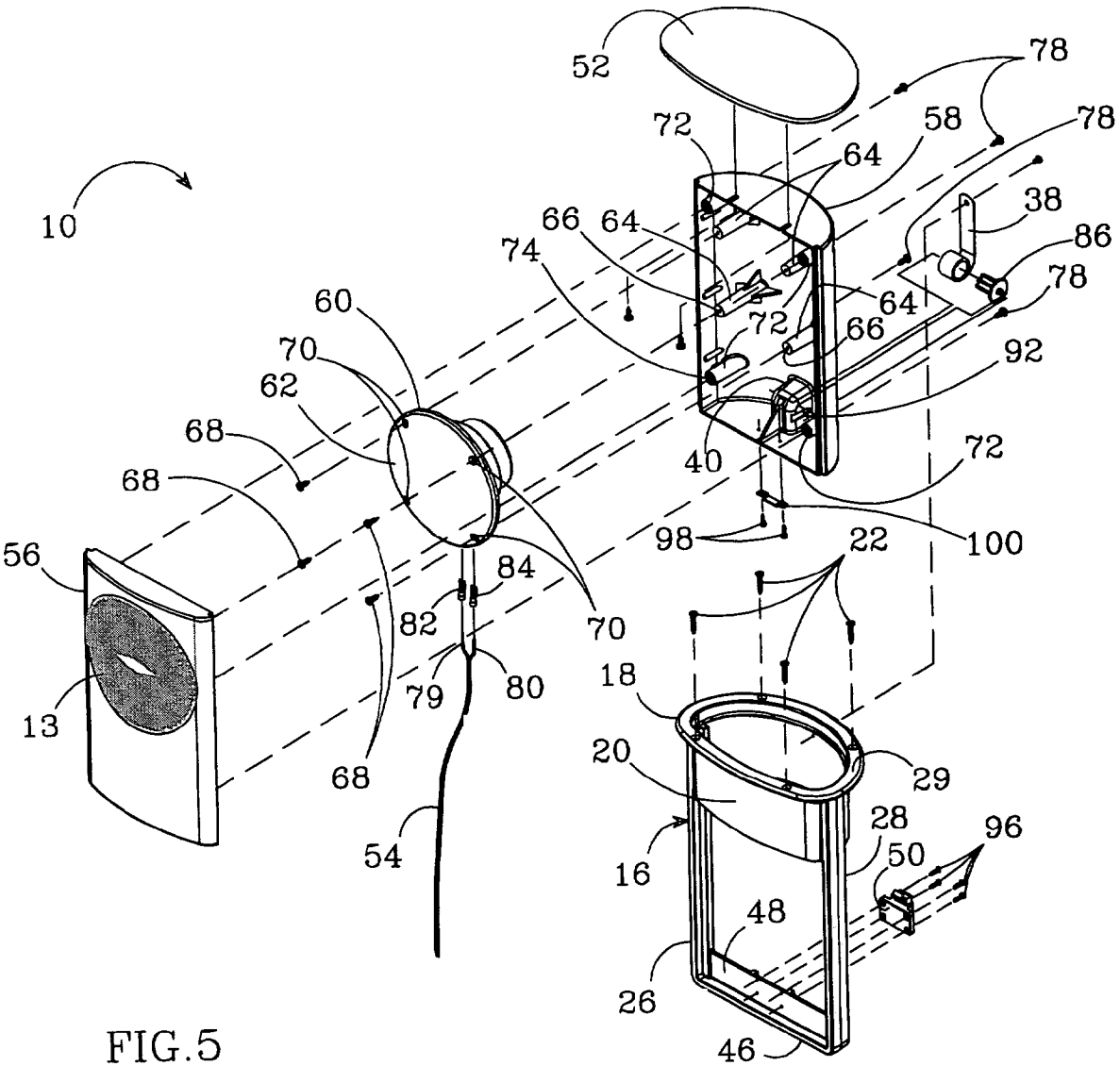
FIG. 5 is an exploded view of the speaker system shown in FIG. 1.

The spa speaker system 10 includes an elongated housing 12 that has a generally clam-shaped cross section and houses a speaker (shown in FIG. 5). The housing 12 has a number of horizontal and parallel slots 13 through its surface that together cover a circular area having a diameter approximately equal the diameter of the face of the housing's speaker (shown in FIG. 5). The speaker is mounted in the housing so that sound from speaker emits through the slots 13.

The speaker system 10 further comprises a U-shaped retaining track 16 with a housing retainer 18 mounted horizontally at the top of the track 16. The retainer has a shape that is similar to the cross-section of the housing 12. The retainer 18 has a sleeve 20 that extends part of the way down the track 16, with the sleeve's cross-section also having a shape similar to the housing's cross-section. The housing 12 is mounted within the track 16 and closely fits within the retainer 18 and sleeve 20, with the housing 12 free to move up and down within the retainer 18 and sleeve 20.

Speaker systems according to the invention can be mounted in many different devices and in many different locations. Speaker system 10 is particularly adapted to use in an acrylic or fiberglass spa on the top horizontal surface around the spa that is above the waterline. The spa can have one or more speaker systems, each of which requires a hole in the horizontal surface. Each hole is shaped similar to the housing and sleeve's cross-section, but slightly larger than the sleeve 20. Notches are also provided on opposite sides of the hole for the track 16. The retainer 18 and track 16 combination are inserted into the hole with a close fit between the hole and the sleeve. The retainer 18 rests on the surface of the spa and the track 16 is hidden below the surface. A gasket, O-ring, or other sealant such as silicon, can be included between the retainer 18 and the surface 102 to provide a watertight seal between the two. Screws 22 are turned into the spa through the retainer holes 24 to mount the retainer 18 to the spa.

Figure 4:
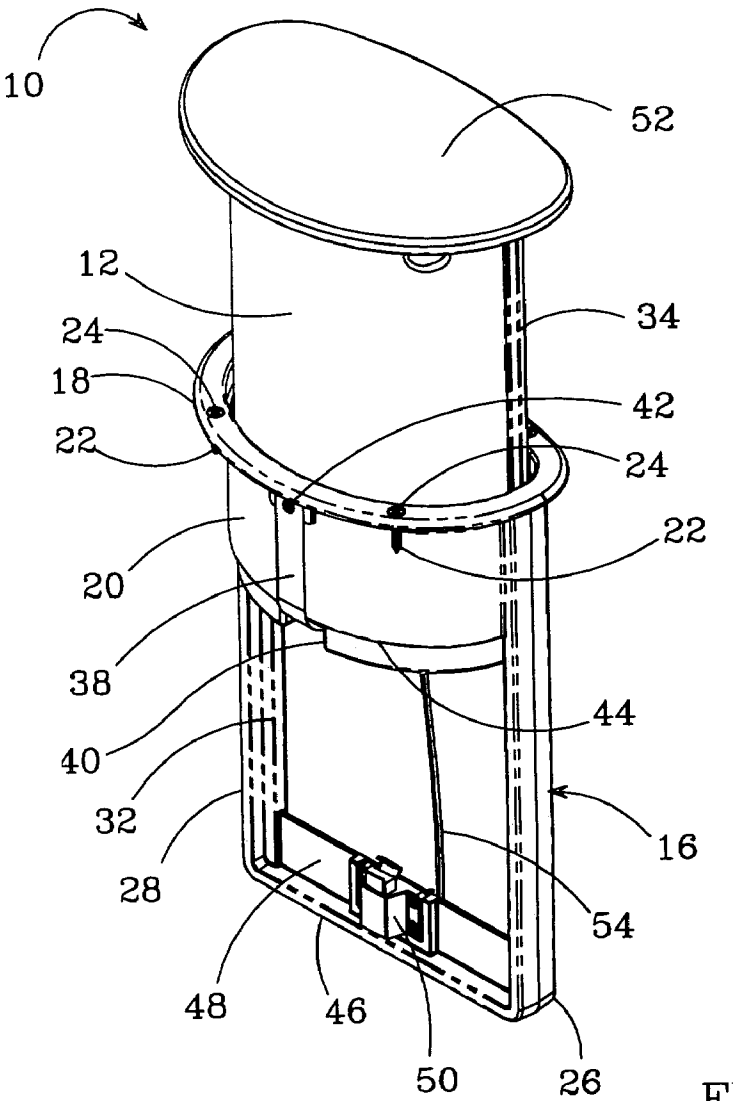
FIG. 4 is a perspective view of the opposite side of the speaker system in FIG. 3.
Figure 3:
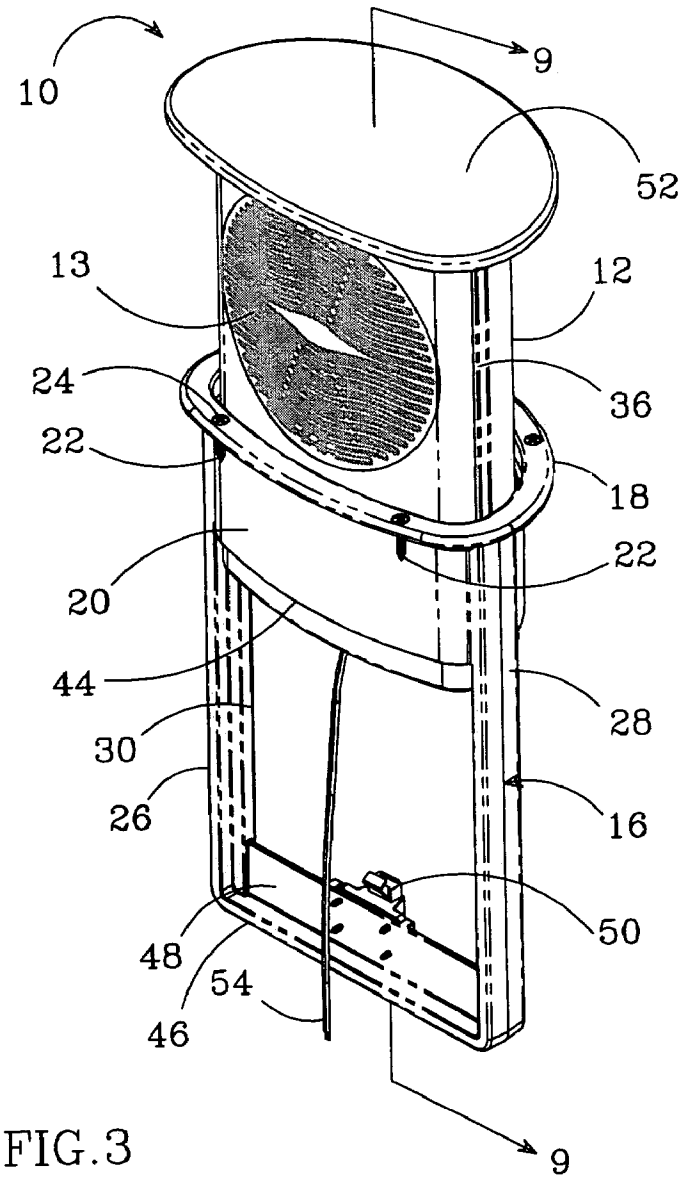
FIG. 3 is a perspective view of the speaker system in FIG. 1, in its extended position.

The track 16 has vertical members 26 and 28 that each has a respective longitudinal rail 30, 32 running most of its length, as shown in FIGS. 3 and 4. The housing 12 has longitudinal slots 34, 36 (also shown in FIGS. 3 and 4) on opposite sides of the housing 12, each of which runs the length of the housing 12. When the housing is mounted in the track 16, each of the rails 30, 32 fits within a respective housing slot 34, 36. When the housing 12 extends and retracts, the slots 34, 36 ride on the rails 32, 34.

A spring 38 is included to provide the force necessary to extend the housing 12 from the track 16. Many different custom and commercially available springs can be used, with a suitable spring being a constant force coil spring such as those provided by Stock Drive Product/Sterling Instrument (SDP/SI) under part numbers A3X50-SH10J29 and A3X50-Sh10K29.

The spring 38 comprises a pre-stressed strip of metal, which tightly turns around itself in successive turns to form a coil. The spring can be mounted at many different locations in different embodiments of a speaker system according to the invention. The speaker system 10 includes a notch 40 (shown in FIGS. 2 and 4) at the base of the housing 12 having a size and shape to house the spring 38. The spring 38 is free to rotate within the notch to unwind the spring 38 from the notch when the end 42 of the spring 38 is extended. The pre-stress in the spring 38 urges the spring to rewind back on itself in the notch 40.

Figure 2:
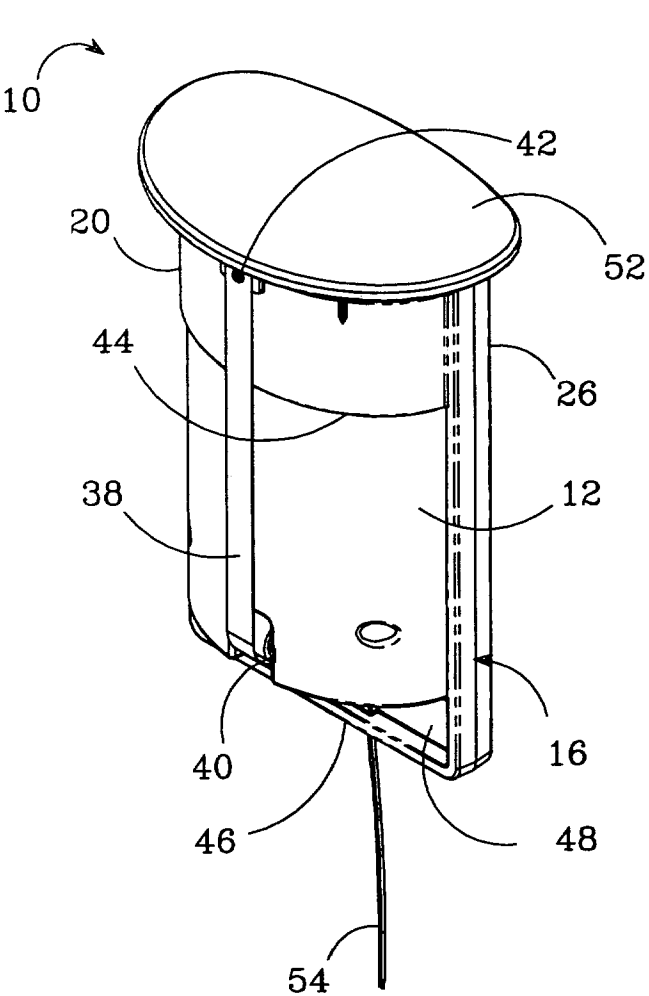
FIG. 2 is a perspective view of the opposite side of the speaker system in FIG. 1.
Figure 1:
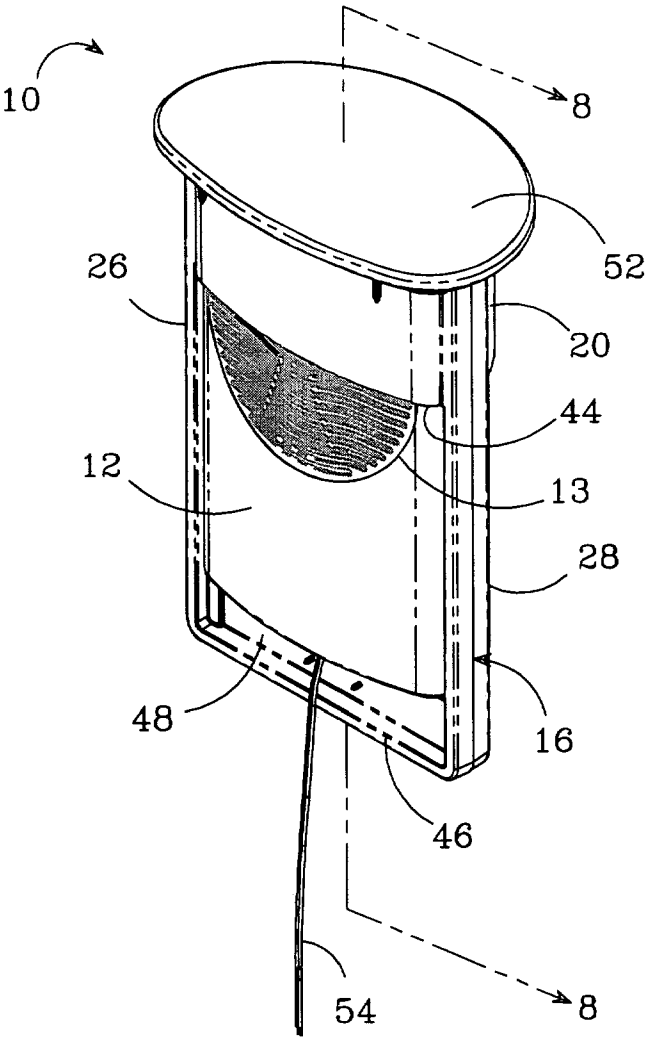
FIG. 1 is a perspective view of one embodiment of spa speaker system according to the present invention, in its retracted position.

In different embodiments of a speaker system according to the invention, the spring end 42 can be attached at different locations. In the speaker system 10, the end 42 is attached to the outside surface of the sleeve 20, at the base of the retainer 18, with part of the spring 38 resting against the outside surface of the sleeve 20. As shown in FIG. 2, when the housing 12 is retracted into the track 16, the spring 38 unwinds and extends from the notch 40. In this position, the extended spring 38 is urged to rewind back into the notch 40 and this urging provides a strong enough spring force to extend the housing 12 from the track 16. At the same time however, the spring force is such that the housing 12 can be conveniently pushed back into the track 16 by a spa occupant until it is fully retracted.

With the end 42 of the spring 38 attached to the sleeve 20 as shown in FIGS. 2 and 4, the bottom edge 44 of the sleeve 20 provides a stop for the extension of the housing 12 from the retaining track 16. As the housing 12 extends from its retracted position, the notch 40 passes the bottom edge 44 so that the bottom edge 44 is between the notch 40 and the extended section of the spring 38 that rests against the outside surface of the sleeve 20, as shown in FIG. 4. The sleeve 20 prevents the spring from rewinding any further, which stops the extension of the housing 12 from the sleeve 20.

The sleeve 20 also provides lateral support for the housing 12 when it is extended from the track 16. If the housing 12 is bumped or jarred laterally, the portion of the housing 12 within the sleeve strikes the interior surface of the sleeve 20. This support helps keep the housing 12 from being jarred off the track rails 30, 32 a spa occupant bumps the housing 12 when it is extended.

The track 16 also has bottom horizontal member 46 that runs between the bottom ends of the vertical members 26, 28 to form the bottom of the U-shaped track 16. A rectangular segment 48 is mounted longitudinally along the inside surface of the horizontal member 46, between the lower inside surfaces of the vertical members 26, 28. The segment 48 provides a stop for the retraction of the housing 12 and provides a vertical surface for mounting a latching mechanism 50, which holds the housing 12 in its retracted position. Many different latching mechanisms 50 can be used with a preferred mechanism being a touch releasable latch, which allows the housing 12 to be released from the latch by a downward pressure on the housing 12. One suitable latching mechanism is the PR-21P Non-magnetic Touch Latch, from Lamp Brand by Sugatsune. It comprises an arm 100 (shown in FIG. 5) mounted to the bottom of the housing 12 that is grabbed by the latch 50 when the housing 12 is retracted. When a downward pressure is applied to the retracted/latched housing 12 to move it down slightly, the latch 50 releases the arm 100 and the housing 12 is free to extend from the track 16.

An aesthetic cap 52 is included on top of the housing 12, with the cap having a shape that is similar to, but slightly larger than, the retainer 18. The cap 52 covers the top of the housing 12 and when the housing is retracted, the cap 52 covers the retainer 18 and the heads of the screws 22. A speaker cable 54 transmits an audio signal to the speaker within the housing 12 causing the speaker to emit sound. The cable 54 passes into the interior of the housing 12 through a hole in the base of the housing 12. The hole also allows water to drain out of the housing 12.

FIG. 5 is an exploded view of the speaker system 10 showing its internal components. The same reference numerals are used to refer to the components in FIG. 5 that are the same as those in FIGS. 1–4.

First and second housing halves 56, 58 are mounted together to form the housing 12 (referenced in FIGS. 1–4), which houses a speaker 60. The second 58 half is deeper than the first half and the surface of the first half 56 has less curvature than that of the second half 58. The face 62 of the speaker 60 can be fit adjacent to the inside surface of the first half 56 adjacent to the circle of slots 13. The second half 58 is deep enough to house most of the speaker 60 with the sound produced by the speaker directed toward the first half 56 and through the slots 13, so that sound from the speaker 60 emits from the housing 12 through the slots 13.

The second half 58 has four internal speaker posts 64 that extend horizontally from its inside surface toward the first half 56. Each of the posts 64 has a threaded hole 66 that mates with one of four speaker screws 68. Each screw 68 passes through one of the speaker holes 70 and is tightened into one of the threaded holes 66. The head of each screw 68 has a larger diameter than the speaker holes 70, so that the screws 68 can securely mount the speaker 60 to the second half 58.

The second half 58 also has four internal mounting posts 72 for mounting the first half 56 to the second half 58, with each of the posts 72 extending horizontally from the second half's inside surface toward the first half 56. Each mounting post 72 is hollow and has an end hole 74 through which mounting screws 78 pass from the outside surface of the second half 58. Each of the mounting screws 78 mates with a threaded hole (not shown) on the inside surface of the first half 56. The head of each screws 78 has a greater diameter than the end holes 74, so that the screws 78 can securely mount the second half 58 to the first half 56 when the screws 78 are fully turned into the first half's threaded holes.

A signal can be transmitted to the speaker 60 in many different ways, including but not limited to, conductive wire or wireless transmission. In the speaker system 10, the signal is sent via a conventional speaker cable 54, which has two conductive wires 79, 80. The wire 79, 80 can be connected to the speaker 60 using many different methods, with a preferred method being clamps 82, 84, each of which is connected to the end of a respective wire 79, 80. The clamps 82, 84 are then clamped to a respective speaker input.

Figure 6:
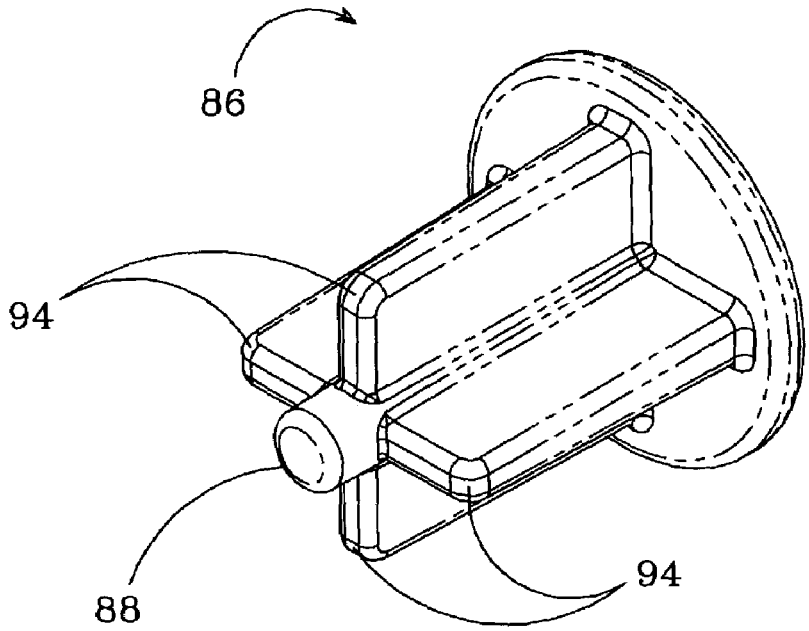
FIG. 6 is a perspective view of the spring drum used in the speaker system of FIG. 1.
Figure 7:
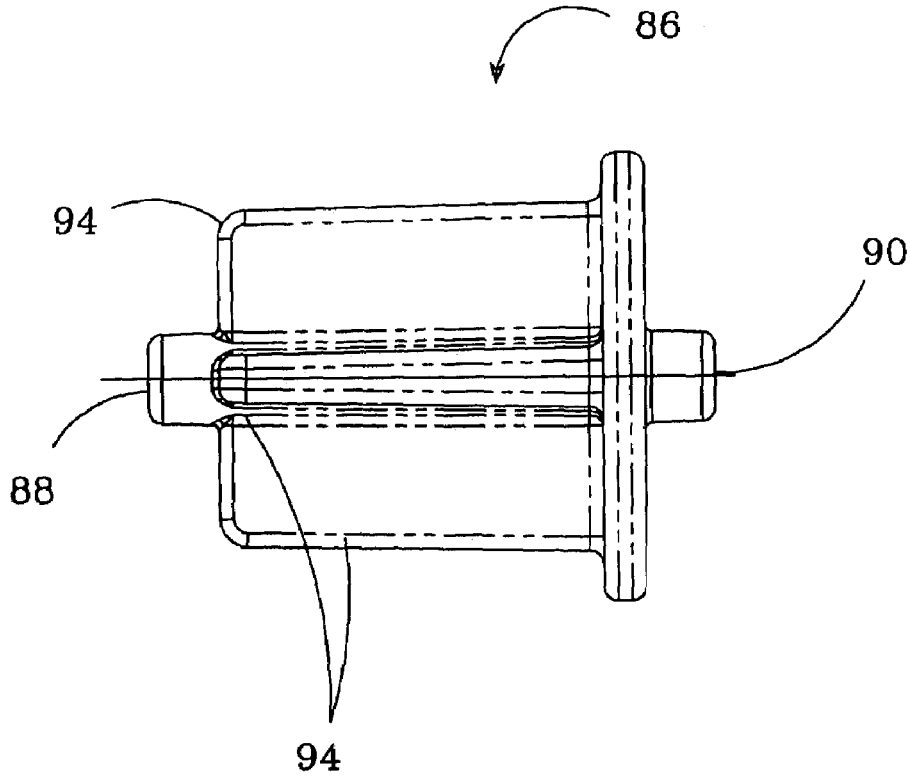
FIG. 7 is an elevation view of the spring drum shown in FIG. 6.

In the speaker 10, the coil spring 38 is mounted to a spring drum 86, which is then housed within the notch 40. FIGS. 6 and 7 show a drum 86 according to the present invention, which has end pins 88, 90 that fit within slots in the notch 40, with only slot 92 shown in FIG. 5. The drum 86 is securely mounted in the notch 40, but is free to rotate and the spring 38 is wound around the drum fins 94. When the spring 38 and drum 86 combination are mounted in the notch 40 and the end 42 of the spring 38 is pulled from the notch 40, the drum 86 rotates in the notch 40 about its pins 88, 90. When the pulling pressure is released from the end 42 of the spring 38, the spring's pre-stress causes it to rewind, which causes the drum 86 to rotate in the opposite direction to rewind the spring 38 onto the drum 86.

Referring again to FIG. 5, latching screws 96 are included to mount the latch 50 to the segment 48 and arm screws 98 are included to mount a latch arm 100 to the bottom of the second half 58. It should be appreciated that where screws are used to mount different features or mechanisms together, many other mounting methods can be used including gluing or clamping.

Figure 8:
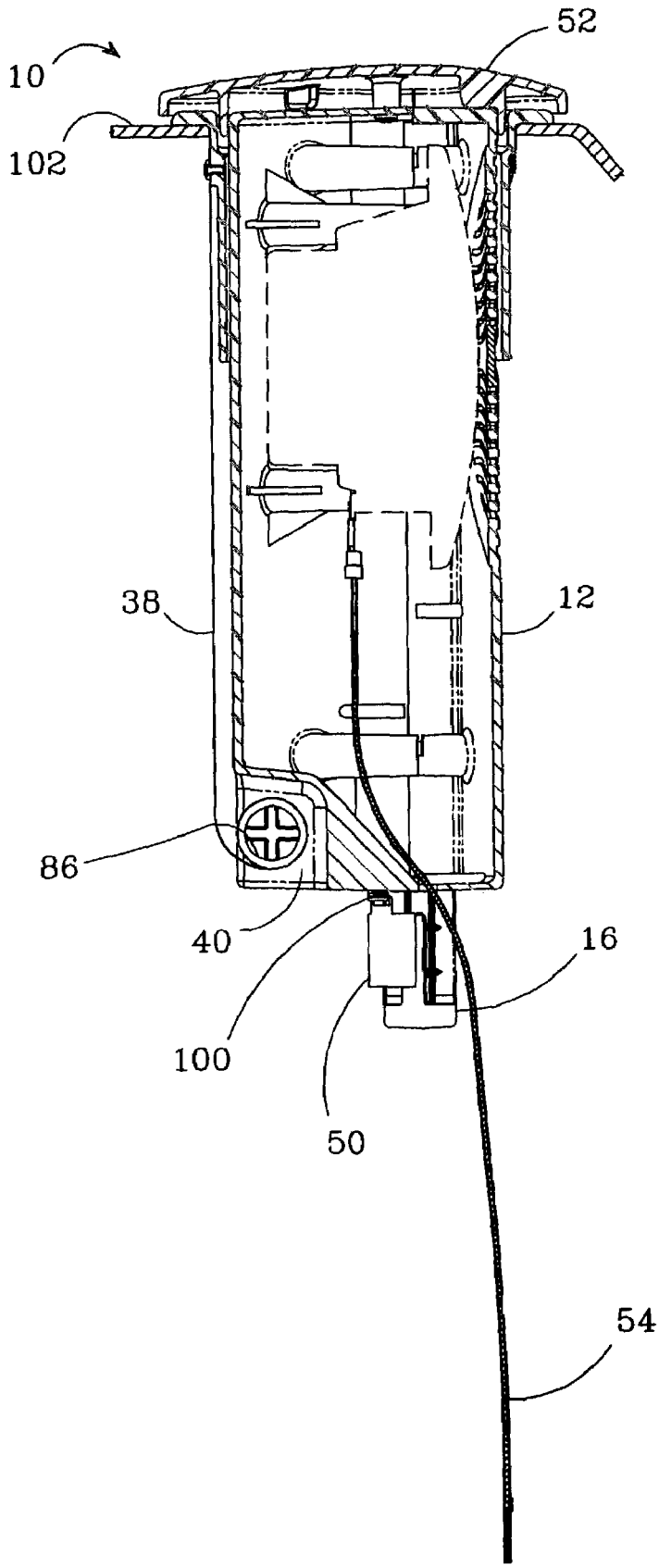
FIG. 8 is a sectional view of the speaker system in FIG. 1, taken along section lines 8—8.

FIG. 8 shows a sectional view of the speaker system 10 mounted to the horizontal surface 102 of a spa. The speaker system 10 is in its retracted position, with the housing 12 retracted into the track 16. The housing 12 and track 16 are hidden below the horizontal surface 102. The spring 38 is extended from the notch 40 and in this position the spring is urged to rewind on the drum 86, which provides an urging to extend the housing 12 from the track 16. To hold the housing 12 within the track against this urging, the latch 50 engages the arm 100. The cap 52 covers the retainer 18 so that only the cap 52 and the edge of the retainer 18 are visible.

To extend the housing 12 from the track 16 a downward pressure is applied to the cap 52, which moves the housing 12 down slightly and causes the latch 50 to release the arm 100. This frees the spring 38 to rewind around the drum 86, which in turn causes the housing 12 to extend from the track and the spa surface 102.

Figure 9:
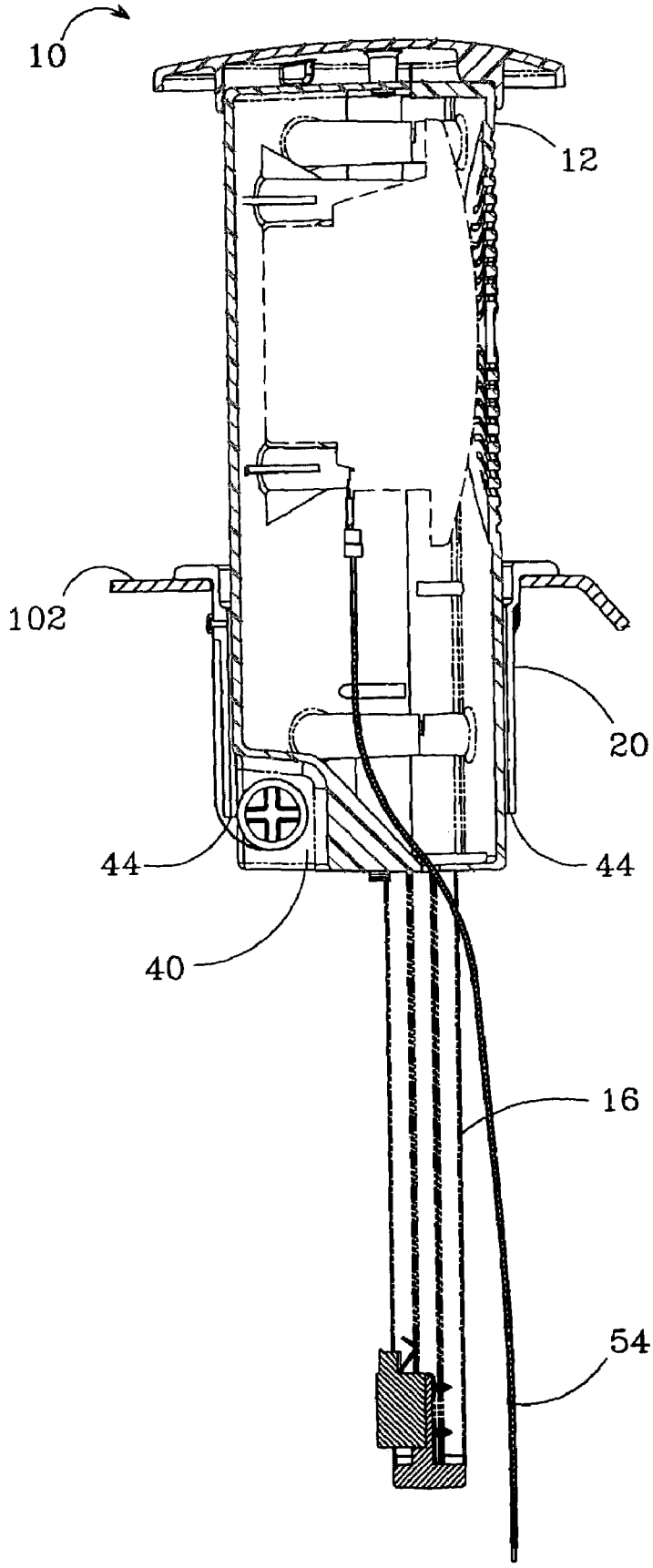
FIG. 9 is a sectional view of the speaker system in FIG. 3, taken along section lines 9—9.

FIG. 9. shows the speaker system 10 in its fully extended position, with the housing 12 extended from the track 16, above the spa's horizontal surface 102. The notch 40 is at the bottom edge 44 of the sleeve 20 with a section of the spring 38 remaining extended from the notch 40 and resting against the outside surface of the sleeve 20. The bottom edge of the sleeve 20 provides a stop for the extension of the housing, as described above. The speaker cable 54 is pulled up as the housing extends from the track 16. The speaker wire 54 should be long enough as installed to move up and down with the housing 12 while not interfering with its extension and retraction.

Figure 10:
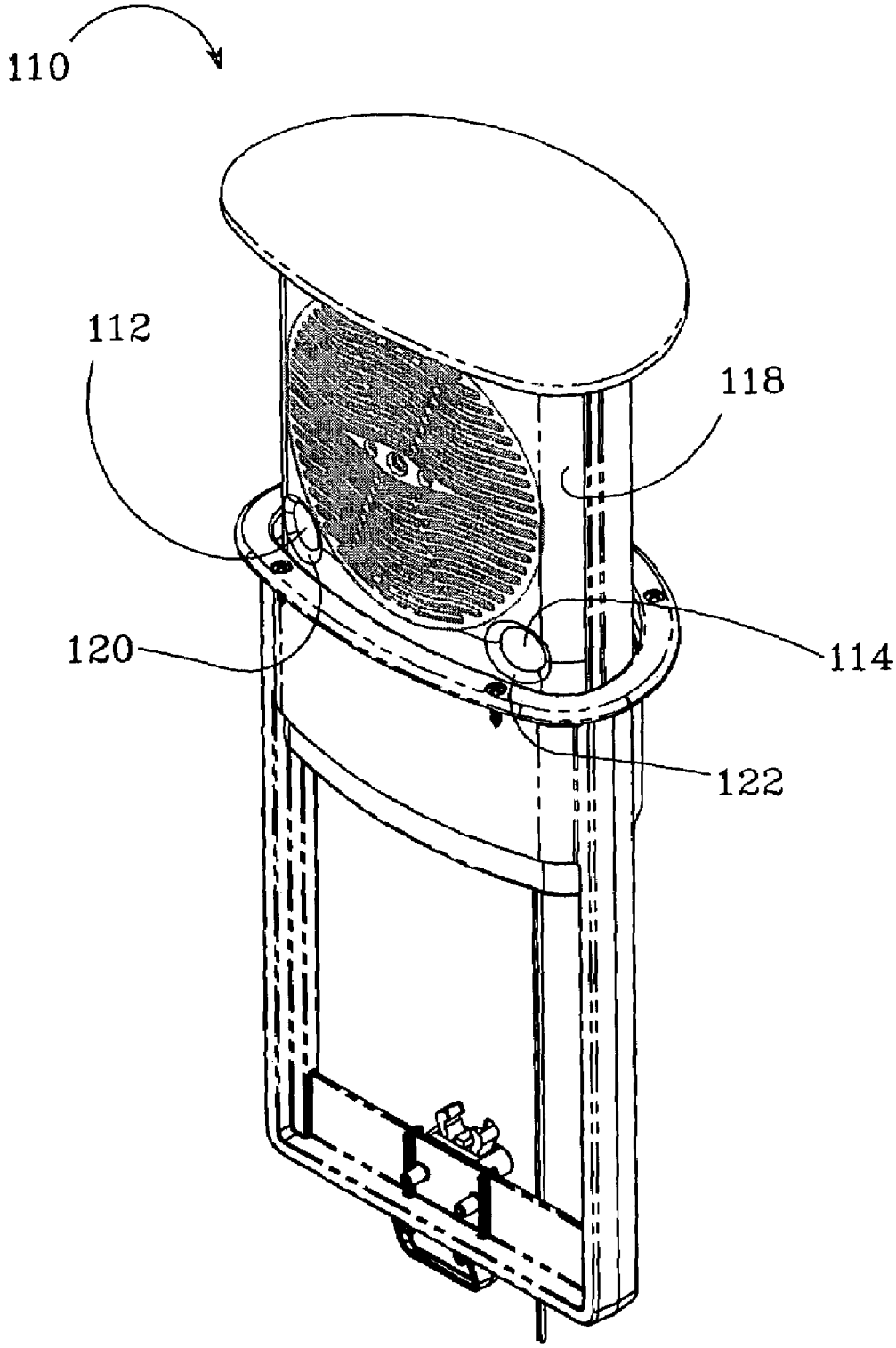
FIG. 10 is a perspective view of another spa speaker system according to the present invention, with dual ports.

FIG. 10 shows another embodiment of a spa speaker system 110 according to the present invention that is similar to the speaker system 10 shown in FIGS. 1–5, 8 and 9, but includes ports 112, 114 that are commonly referred to as acoustic tuned base reflex ports, tune ports or base reflex ports ("ports"). The ports are designed to the specifications of the speaker 116 and the cubic volume of the speaker housing 118. Each of the ports 112, 114 is a hole through the housing that has a respective shoulder 120, 122 that extends to the interior of the housing 118. The diameter of each of the ports 112, 114 and the depth of their respective shoulders 120, 122, are engineered so that the low end frequency response of the speaker is enhanced. For instance, the typical low end frequency response of a typical speaker 116 in the housing without ports is approximately 20 Hz, while the same speaker 116 in a housing 118 has a response of 50 Hz. With the ports 112, 114, the speaker 116 in the housing 118 has superior low-end sound quality compared to stand alone speakers or speakers without ports.

In many conventional speaker housings a single port is used. However, the housing 118 has a clam shaped cross section, which results in a reduced housing depth. To obtain the desired low-end sound quality with this reduced housing depth the speaker housing has two ports that give the same or better low-end response compared to a conventional single port in a speaker system with a circular cross-section. In other embodiments of the speaker system 110, a different number of ports can be included in different locations on the housing.

Figure 11:
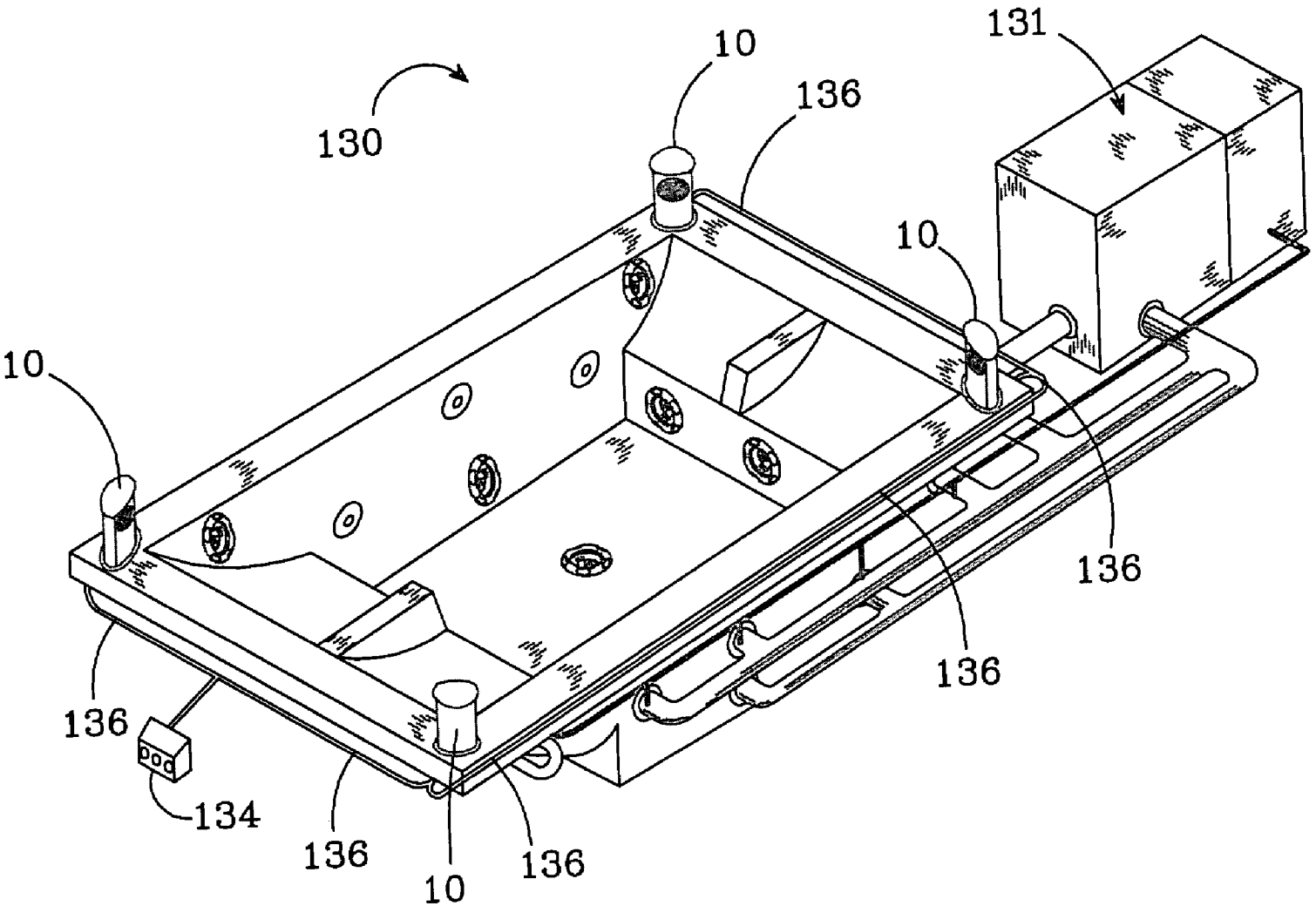
FIG. 11 is a perspective view of a spa using spa speaker systems according to the present invention.

FIG. 11 shows a spa 130 with a plurality of spa speaker systems 10 arranged on the horizontal surface 132 around the edge of the spa 130. Speaker systems according to the present invention can also be arranged at many different locations and can be included in other reservoirs of water such as a pool, hot tub, or bathtub. The spa's plumbing system 131 includes pumps, filters and conduits, and the plumbing system can consume much of the space behind the spa wall. An audio system 134 generates an audio signal to be transmitted to the speaker systems 10 over speaker cable 136, although the audio signal can also be transmitted to the speakers wirelessly. In a wireless embodiment the speaker systems 10 would have a wireless receiver to receive the wireless audio signal. The audio system 134 can be any apparatus that generates an audio signal including but not limited to a television, compact disc player, receiver, tape player, digital video disc player, VHS player, etc. The audio system 134 can be remote to or part of the spa 130. The housings of each speaker system can be extended alone or in combination with other housings. The generally oval cross-section of each housing allows each speaker system to be mounted on a smaller horizontal surface compared to a conventional housing having the same sized speaker and a housing having a round cross-section. This allows the speaker system 10 to fit in locations where a conventional speaker system might not fit.

Although the present invention has been described in considerable detail with reference to certain preferred configurations, other versions are possible. Different components can be used in speaker systems according to the invention and the speaker system components can be arranged in different ways. For instance, different springs can be used and can be attached to the speaker system in different locations. Therefore, the spirit and scope of the appended claims should not be limited to the preferred versions described above.

We claim:

1. A spa speaker system, comprising:

a housing having a speaker mounted within it;

a track, said housing movably mounted to said track, said housing extendable and retractable from the top of said track;

a latching mechanism operable to hold said housing in its retracted position and operable to release said housing, said housing extending from said track when said housing is released by said mechanism; and a spring, wherein one end of said spring is mounted to said housing and the other end is mounted to said track, an urging of said spring pulling said housing to its extended position when said mechanism releases said housing.

2. The speaker system of claim 1, wherein said spring comprises a constant force coil spring.

3. The speaker system of claim 1, wherein said latching mechanism comprises a touch releasable latch that engages and holds said housing in its retracted position and releases said housing in response to a downward pressure on said housing.

4. The speaker system of claim 1, wherein said track has first and second vertical members and a bottom member arranged in a U-shape, said housing riding up and down on said vertical members, said latching mechanism mounted to said bottom member.

5. The speaker system of claim 1, wherein said vertical members have longitudinal rails and said housing has longitudinal slots to mate with said rails, said slots riding up and down on said rails.

6. The speaker system of claim 1, wherein said housing has a clam-shaped cross-section.

7. The speaker system of claim 1, having a retainer mounted to the top of said track, said retainer arranged to mount said track to the surface of a spa, said housing extendable from the surface of said spa as it extends from said housing.

8. The speaker system of claim 1, further comprising a stop to prevent said housing from fully extending from said track.

9. The speaker system of claim 1, wherein said housing has one or more ports to enhance said speaker's low-end frequency response.

10. A system for providing audio to a reservoir of water, comprising:

a reservoir shell capable of holding water;

a plurality of speaker systems mounted to said reservoir shell above the water line, each of said speaker systems capable of receiving an audio signal and generating sound toward occupants of said reservoir shell, each of said speaker systems comprising a speaker housing that is retractable to be substantially hidden behind said reservoir shell and is extendible from said reservoir shell, said housing of each of said speaker systems extendible independent of the other speaker systems, said speaker systems each comprising: a latching mechanism operable to hold said housing in its retracted position and operable to release said housing, said housing extending from said track when said housing is released by said mechanism; and a spring, wherein one end of said spring is mounted to said housing and the other end is mounted to said track, the an urging of said spring pulling said housing to its extended position when said mechanism releases said housing; and an audio system for generating an audio signal and transmitting said audio signal to said speaker systems.

11. The system of claim 10, wherein said audio system wirelessly transmits said audio signal to said speaker systems.

12. The system of claim 10, wherein said audio system transmits said audio signal to said speaker systems over speaker cables.

13. The system of claim 10, wherein each of said speaker systems further comprise a speaker mounted within said speaker housing to provide sound to occupants of said reservoir shell.

14. The system of claim 10, wherein said spring comprises a constant force coil spring.

15. The system of claim 10, wherein said latching mechanism comprises a touch releasable latch that engages and holds said speaker housing in its retracted position and releases said speaker housing in response to a downward pressure on said speaker housing.

16. The system of claim 10, wherein said track has first and second vertical members and a bottom member arranged in a U-shape, said speaker housing riding up and down on said vertical members, said latching mechanism mounted to said bottom member.

17. The system of claim 10, wherein said vertical members have longitudinal rails and said speaker housing has longitudinal slots to mate with said rails, said slots riding up and down on said rails.

18. The system of claim 10, wherein said housing has a clam-shaped cross-section.

19. The system of claim 10, having a retainer mounted to the top of said track, said retainer arranged to mount said track to the surface of a reservoir shell.

20. The system of claim 10, wherein each of said speaker systems further comprises a stop to prevent its said speaker housing from fully extending from said reservoir shell.

21. The system of claim 10, wherein said housing in each of said speaker systems has one or more ports to enhance low-end frequency response.

22. A speaker system, comprising:

a speaker housing for holding a speaker;

a holding mechanism for holding said speaker housing, said speaker housing partially extendible from and fully retractable into said holding mechanism;

a spring, wherein one end of said spring is mounted to said housing and the other end is mounted to said track, an urging of said spring pulling said housing to its extended position when said mechanism releases said housing, a latching mechanism for holding said speaker housing in its retracted position against said urging means, said latching mechanism operable to release said speaker housing.

23. The speaker system of claim 22, wherein said holding mechanism comprises a U-shaped track comprising two vertical members and a bottom member.

24. The speaker system of claim 23, wherein said latching mechanism comprises a touch releasable latch that releases said speaker housing in response to a downward pressure on said speaker housing.

25. The speaker system of claim 24, wherein said touch release latch is mounted to said bottom member.

26. A spa speaker system, comprising:

a housing having a speaker mounted within it, said housing having one or more ports to enhance the sound generated by said speaker system;

a track, said housing movably mounted to said track; and a latching mechanism operable to hold said housing in its retracted position and operable to release said housing, said housing extending from said track when said housing is released by said mechanism; and a spring, wherein one end of said spring is mounted to said housing and the other end is mounted to said track, an urging of said spring pulling said housing to its extended position when said mechanism releases said housing.

27. A spa speaker system, comprising:

a speaker housing for holding a speaker;

a holding mechanism for holding said speaker housing, said speaker housing partially extendible from and fully retractable into said holding mechanism; and a means for pulling said speaker housing to extend from said holding mechanism, wherein one end of said means is attached to said speaker housing and the other end is attached to said holding mechanism.

28. The speaker system of claim 27, wherein said pulling means comprises a coil spring.

* * * * *